US007296636B1

(12) United States Patent
Vreeland

(10) Patent No.: US 7,296,636 B1
(45) Date of Patent: Nov. 20, 2007

(54) APPARATUS FOR DRIVING FENCE POSTS AND THE LIKE

(76) Inventor: Gregory M. Vreeland, 1217 Lyons Rd., Centerville, OH (US) 45458

( * ) Notice: Subject to any disclaimer, the term of this patent is extended or adjusted under 35 U.S.C. 154(b) by 21 days.

(21) Appl. No.: 11/231,719

(22) Filed: Sep. 21, 2005

(51) Int. Cl.
*E21C 5/00* (2006.01)

(52) U.S. Cl. ..... 173/184; 173/185; 173/90; 405/259.1; 405/232

(58) Field of Classification Search ..... 173/184, 173/185, 90; 405/259.1, 232
See application file for complete search history.

(56) References Cited

U.S. PATENT DOCUMENTS 2,407,444 A * 9/1946 Pfingsten ..... 173/205
3,073,571 A * 1/1963 Wunsch ..... 254/29 R
3,672,521 A 6/1972 Bauer et al.
3,700,047 A * 10/1972 Gartner ..... 173/28
3,703,934 A * 11/1972 Cartner ..... 173/193
3,783,953 A * 1/1974 Kopaska ..... 173/187
4,130,168 A * 12/1978 Deike ..... 173/38
4,193,459 A * 3/1980 Engstrom ..... 173/193
4,261,400 A * 4/1981 Spence ..... 144/195.1
4,915,180 A * 4/1990 Schisler ..... 173/185
5,012,873 A * 5/1991 Kennedy et al. ..... 173/185
5,098,252 A 3/1992 Sheesley et al.
5,375,664 A * 12/1994 McDowell et al. ..... 173/1
5,494,117 A * 2/1996 Aldridge ..... 173/28
5,558,169 A * 9/1996 Madgwick et al. ..... 173/185
5,562,397 A 10/1996 Albright
5,697,457 A * 12/1997 Back ..... 173/185
6,234,260 B1 * 5/2001 Coast et al. ..... 175/113
6,234,719 B1 * 5/2001 Roynestad ..... 405/232
7,004,262 B1 * 2/2006 Voichoskie et al. ..... 173/46
7,063,172 B1 * 6/2006 Marentette ..... 173/184
2003/0173095 A1 * 9/2003 Boley et al. ..... 173/89

* cited by examiner

*Primary Examiner*—Brian D. Nash
(74) *Attorney, Agent, or Firm*—Jacox, Meckstroth & Jenkins

(57) ABSTRACT

A post driver unit includes a frame having a quick connect attachment to a front end loader vehicle in place of a bucket or for connecting the unit to a tractor using a three point hitch. The frame supports a vertical mast for rotation on a vertical axis by fluid actuated cylinder, and the mast supports an elongated boom for pivotal movement on a horizontal axis. A fluid actuated impact driver depends directly from an outer end portion of the boom by a universally supported connector member to provide the impact driver with a vertical axis, and the boom is pivoted by a fluid actuated cylinder system which provides for rapidly raising the boom and the impact driver and lowering the boom and impact driver at a controlled slower rate. The connector member may have different lengths according to the length of the post to be driven.

11 Claims, 4 Drawing Sheets

50
48
72
44
56
46
68
77
54
66
28
52
75
10
62
53
79
119
63
64
117
115
40
38
34
18
31
80'
26
104
24
102
14
16

APPARATUS FOR DRIVING FENCE POSTS AND THE LIKE

BACKGROUND OF THE INVENTION

This invention relates to apparatus for driving fence posts and stakes into the ground and which is supported and transported by a motor driven vehicle. Such apparatus is disclosed in U.S. Pat. No. 6,796,747 which issued to applicant and the disclosure of which is herein incorporated by reference. This apparatus incorporates a hydraulically actuated impact hammer or driver, and another form of post driver which uses a hydraulically actuated impact driver is disclosed in U.S. Pat. No. 5,494,117. In such post driving equipment or apparatus, it has been found desirable for the apparatus to be usable for driving long posts, such as eight foot posts of tubular steel as commonly used for a chain link fence and also for driving shorter posts such as five feet or six feet T-type fence posts or wood silt fence posts which commonly range between thirty-two and forty-two inches. It has also been found desirable for the apparatus to incorporate a vertical mast which may be adjusted vertically and which pivotally supports a generally horizontal boom having an outer end portion connected directly to the impact tool or driver so that the driver moves vertically directly with the boom.

When the impact tool or driver is used for driving long posts into the ground and the driver is located above a person's head, it has been found desirable to control the maximum rate of downward movement of the boom and the impact driver so that the boom and impact driver do not fall freely in the event a post breaks or buckles. When a vehicle supporting the apparatus is transversing along a grade or hill, it is also desirable for the operator of the vehicle to have remote control over rotation of the mast and boom on the axis of the mast so that the suspended impact driver may be vertically aligned over the vertical post to be driven. As used herein, the term post includes posts and stakes of different lengths and different types, such as tubular metal posts, T-type fence posts and wood stakes as commonly used for installing silt fence,

SUMMARY OF THE INVENTION

The present invention is directed to improved apparatus for driving a post into the ground and which provides all of the desirable features mentioned above. In addition, one embodiment of the invention provides for quickly attaching and detaching the post driving apparatus to a front end loader vehicle in place of a bucket or to a wheel supported vehicle having a three point hitch. In accordance with one embodiment of the invention, a fence post driver apparatus or unit includes a frame which supports a vertical mast for rotation on a vertical axis, and the mast is rotated by a double acting fluid or hydraulic cylinder connecting the frame to a radial arm on the mast. A generally horizontal boom is pivotally supported by an upper end portion of the mast for rotation on a horizontal axis, and an outer end portion of the boom supports an impact hammer or post driver connected directly to the boom through a universal joint.

A bottom end portion of the impact driver carries a tubular socket for receiving the upper end portion of a post to be driven into the ground. The boom is pivoted upwardly by a fluid actuated lift cylinder which connects the mast to a channel or bracket supporting the boom, and another fluid cylinder connects the boom to the mast and controls the maximum rate at which the boom and the impact driver pivot downwardly while the impact hammer is driving a post into the ground. Interchangeable rigid link members may be used to connect the universal joint to the impact driver according to the length of the post. In one embodiment, the frame is also provided with a quick attachment device for rigidly connecting the apparatus to the pivotal arms of a front end loader vehicle after the bucket has been removed.

Other features and advantages of the invention will be apparent from the following description, the accompanying drawings and the appended claims.

DESCRIPTION OF THE PREFERRED EMBODIMENTS

Figure 1:
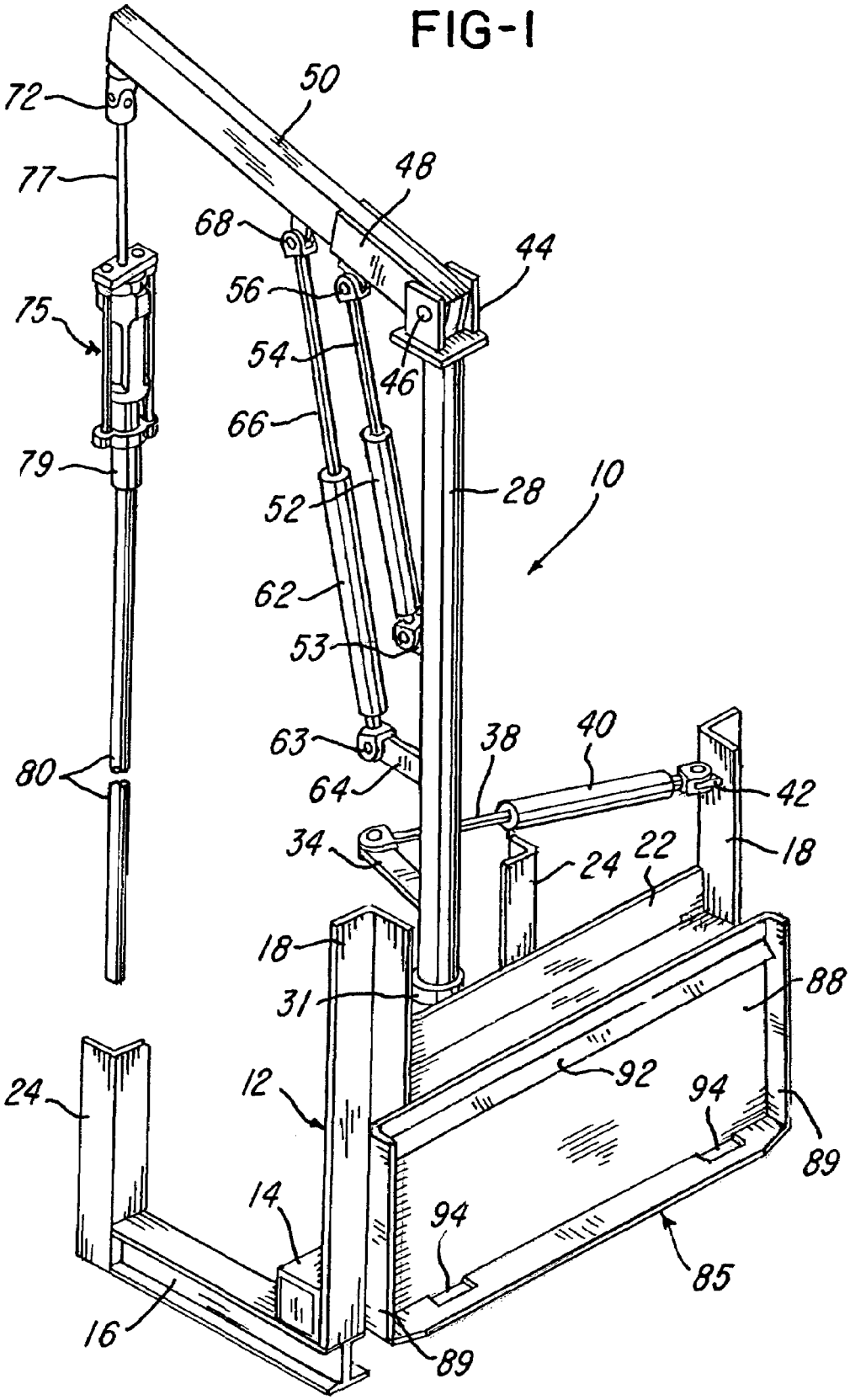
FIG. 1 is a perspective view of apparatus for driving posts into the ground and constructed in accordance with one embodiment of the invention.

FIG. 1 illustrates a post driving unit or apparatus 10 constructed in accordance with the invention and which includes a frame 12 formed by a horizontal square tubular cross frame member 14 having end portions welded to a pair of horizontal base beams or members 16 and to a pair of vertical angle members 18 which are also rigidly connected by a horizontal angle member 22. The frame 12 also includes a pair of vertical angle members 24 which are welded to the ends of the base members 16 and cooperate to form a rack for supporting a supply (not shown) of posts to be driven into the ground. The cross frame member 14 also supports a vertical cylindrical mast 26 (FIGS. 2 & 3) which projects into a cylindrical outer mast extension 28 supported on the mast 26 by a vertically adjustable annular collar 31 (FIG. 3) secured to the mast 26. The mast extension 28 is free to rotate on the mast 26 and may be adjusted vertically by adjusting the collar 31 vertically. A horizontal arm 34 is welded to the mast extension 28 and is pivotally connected to the piston rod 38 of a double acting fluid or hydraulic cylinder 40 which is pivotally connected to an ear 42 welded to a frame member 18. Actuation of the cylinder 40 is effective to rotate the mast extension 28 in opposite directions on the supporting mast 26 and on the collar 31.

A U-shaped bracket 44 is welded to the upper end of the mast extension 28 and receives a cross pin 46 which pivotally supports both a U-shaped support member or channel 48 and one end of an elongated tubular boom 50 which is received within and extends from the support channel 48. A double acting fluid or hydraulic cylinder 52 is pivotally connected to a vertical tab or ear 53 welded to the mast extension 28 and has a piston rod 54 pivotally connected by a pin 56 to a tab or ear projecting downwardly from the boom support channel 48. A single acting fluid or hydraulic cylinder 62 is pivotally connected by a cross pin 63 to an arm 64 welded to the mast extension 28 and has a piston rod 66 pivotally connected by a cross pin 68 to a tab or ear projecting downwardly from the boom 50.

Figure 2:
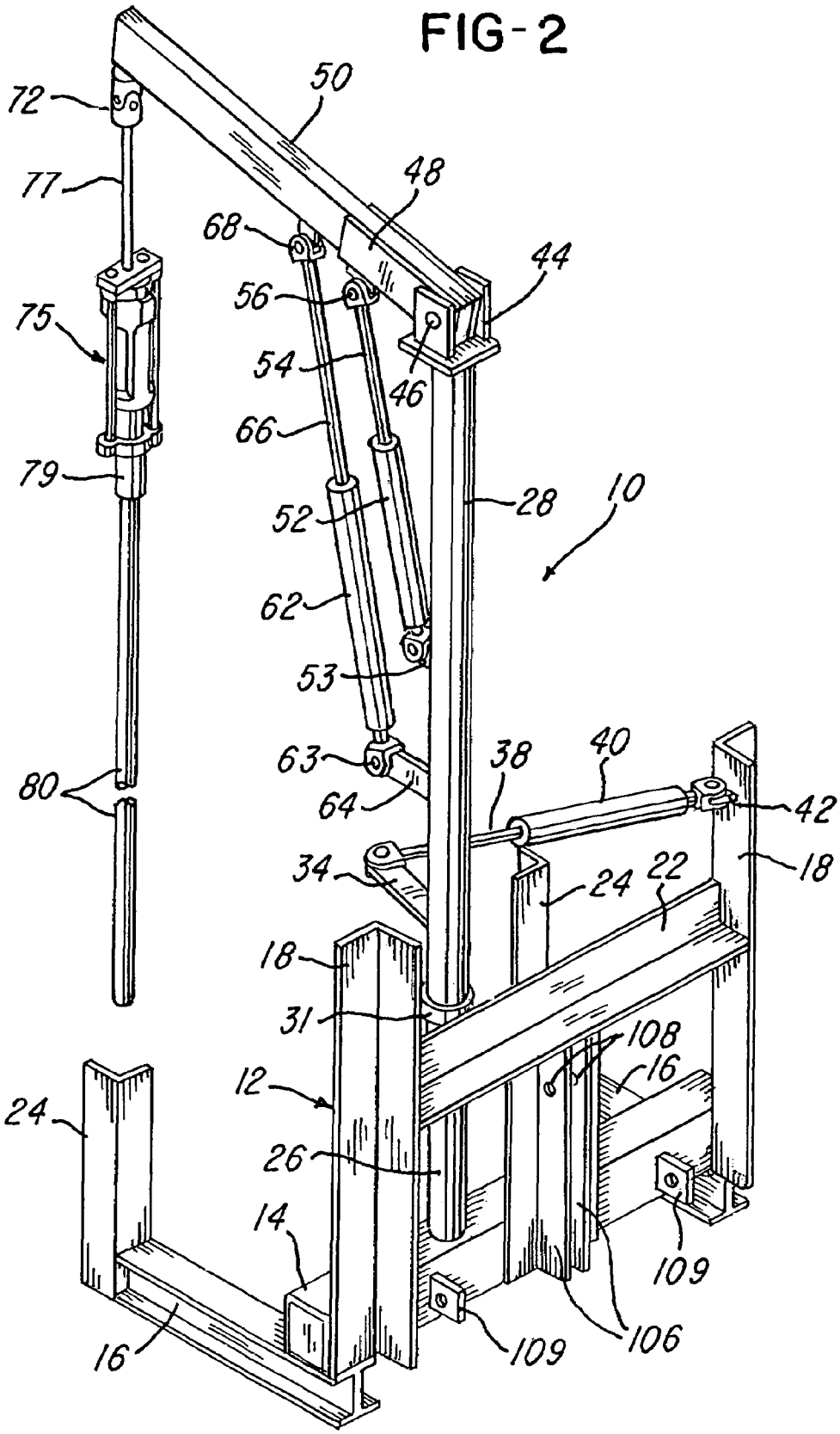
FIG. 2 is a perspective view of another embodiment of post driving apparatus also constructed in accordance with the invention.

The outer end portion of the boom 50 supports a universal coupling or joint 72 which is connected directly to a fluid or hydraulic actuated impact hammer or driver 75 by a connecting member 77. One form of hydraulic impact hammer or driver 75 which has provided satisfactory results is manufactured and sold under the trademark FAIRMONT as a sign post driver, as disclosed in above mentioned U.S. Pat. No. 6,796,747. The impact driver 75 is provided with an open bottom tubular socket member 79 for receiving the upper end portion of a post 80 which is to be driven into the ground. As illustrated in FIGS. 1 & 2, the post 80 is in the form of a tubular steel post which is commonly used for installing a chain link fence. Typically, the tubular post 80 has a length of eight feet and is driven two feet into the ground for supporting a six foot high chain link fence. The universal joint 72 and the direct connect member 77 support the depending impact driver 75 with a vertical axis at all times, and the member 77 may have any length depending upon the length of the post to be driven into the ground. For example, the connecting member 77 may provide for attaching the impact driver 75 directly to and adjacent the universal joint 72 or may be in the form of an elongated rod or link member, as illustrated in FIGS. 1 & 2. The link member 77 is interchangeable with other link members having a different length so that the boom is substantially level or horizontal when a post is driven one-half of the desired depth into the ground.

Referring to FIG. 1, a quick connect coupling or attachment device or system 85 is secured to the frame 12 to provide for quickly attaching the post driving apparatus 10 to the forwardly projecting and pivotally supported arms of a front loader vehicle, for example, of the type sold under the registered trademark BOBCAT by the Bobcat Company in West Fargo, N. Dak. This vehicle is usually provided with a quick attachment device such as disclosed, for example, in U.S. Pat. No. 3,672,521, No. 5,098,252 and No. 5,562,397, the disclosures of which are herein incorporated by reference. The vehicle provides for a number of different attachments or equipment which can be carried and operated by the front end loader vehicle in place of a tiltable bucket. As shown in FIG. 1, the attachment device 85 includes a generally vertical plate 88 having opposite end flanges 89 and a horizontal and inclined upper flange 92 and a lower flange 93. The lower flange 93 has horizontally spaced recesses or openings 94 for receiving retractable locking pins or wedges. The attachment system produced by the Bobcat Company is sold under the trademark BOBTACH and provides a convenient system for quickly attaching the post driving apparatus 10 to the front end of a BOBCAT vehicle.

The post driving unit or apparatus 10 may also be equipped for mounting the apparatus on a wheel supported vehicle or tractor having a three point hitch system. Commonly, the hitch system includes a pair of horizontally spaced lift arms 102 (FIG. 3) and a single stabilizing upper arm 104. For attaching the arms 102 and 104 to the apparatus 10, a modified frame 12' replaces the attachment device 85 with a pair of spaced vertical angle members 106 (FIG. 2) which have horizontally aligned holes 108 for receiving a cross-pin (not shown) extending through an end portion of the stabilizing arm 104. A pair of horizontally spaced tabs or ears 109 are welded to the frame member 14, as shown in FIG. 2, and have horizontally aligned holes for receiving opposing projecting pins which extend through swivel sockets on the end portions of the lift arms 102, as shown in FIG. 3.

Figure 3:
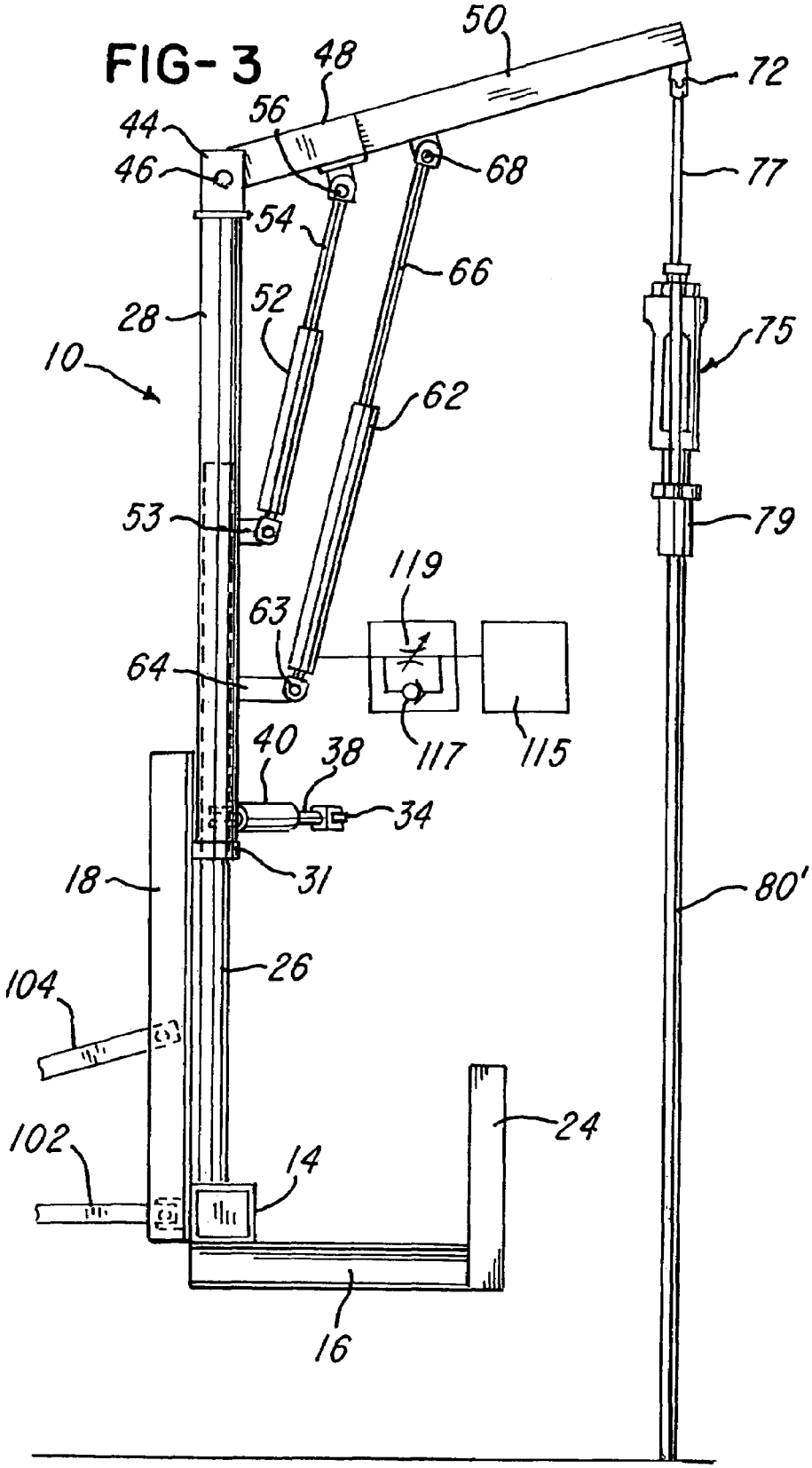
FIG. 3 is a side elevational view of the apparatus shown in FIG. 2 and illustrating the apparatus for driving a T-type metal fence post.

Referring to FIG. 3, the single acting cylinder 62 receives hydraulic fluid through a line connected to a fluid reservoir 115 and having a one way check valve 117 and a needle valve 119 connected in parallel within the line. The post driving apparatus 10 is shown elevated in FIG. 2 by the arms 102 and 104 to a level for driving a T-type metal fence post 80' into the ground with the post 80' normally having a length of five or six feet. The boom 50 is pivoted upwardly from its generally horizontal normal position by the hydraulic cylinder 52 and the support bracket or channel 48. If the post 80' is to be driven into the ground, for example, about two feet, the boom 50 is pivoted upwardly until the universal joint 72 is about one foot above a horizontal reference plane extending through the axis of the pivot pin 46 for the boom 50. Thus after the post is driven into the ground, the universal joint will be about one foot below the reference plane. As a result, horizontal movement of the hydraulically actuated impact driver 75 is minimized through the arcuate travel of the universal joint 72.

Figure 4:
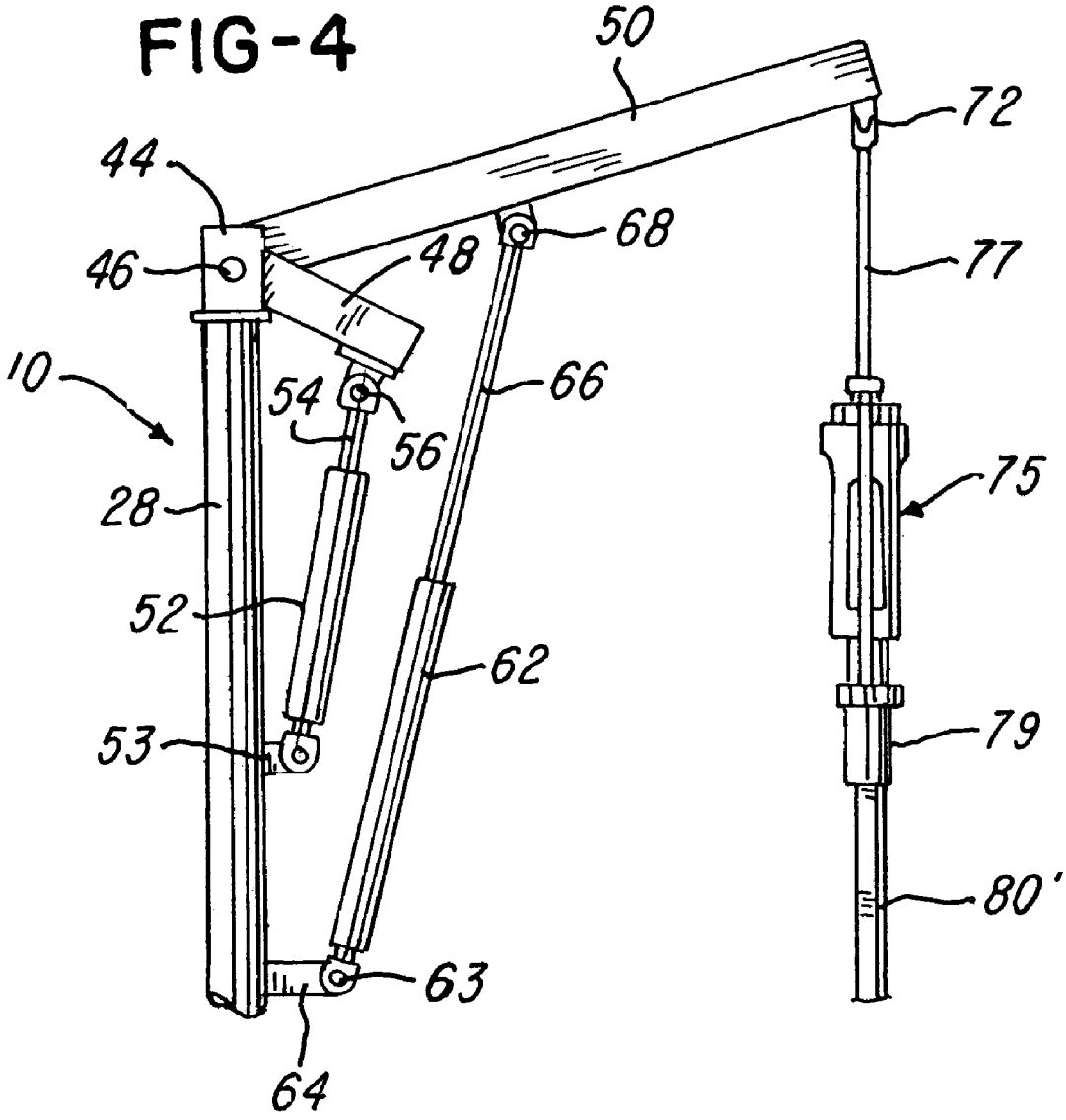
FIG. 4 is a fragmentary view of the apparatus shown in FIG. 3 while driving the post into the ground.

As the boom 50 is being pivoted upwardly by the cylinder 52, hydraulic fluid flows freely from the reservoir 115 through the check valve 117 and into the cylinder 62 so that the cylinder 62 does not create any significant resistance to raising the boom. After the post 80' is positioned vertically at the location where it is to be driven into the ground and driver 75 is positioned so that the upper end portion of the post is received within the socket 79, the cylinder 52 is actuated to retract its piston rod 54 and pivot the boom support bracket or channel 48 to a downwardly inclined position, as shown in FIG. 4. The hydraulic impact hammer or driver 75 is then actuated to drive the post 80' into the ground with repeated impacts. The needle valve 119 is adjusted so that the boom 50 pivots downwardly at a controlled rate corresponding generally with the rate at which the post 80' is driven into the ground by the impact hammer or driver 75. Thus in the event the post breaks or buckles, the boom 50 and the impact driver 75 move downwardly at a slow rate due to the resistance of the cylinder 62 and do not drop down quickly. This safety feature is especially desirable when driving a post having a substantial length, for example, eight feet, and the impact driver 75 is located considerably above the head of the operator while driving the post. When it is desired to drive another long post, the cylinder 52 is actuated to pivot the boom lifting channel 48 and the boom 50 upwardly to its starting position, as shown in FIG. 3, and also to extend the piston rod 66 of the cylinder 62.

As mentioned above, another desirable feature of the apparatus 10 is the attachment device 85 which permits the apparatus to be quickly attached to a front loader vehicle such as a BOBCAT vehicle in place of the bucket or another attachment. As a result, the operator of the vehicle may always view the location of the impact driver 75 and operate the lift cylinder 52 and mast rotation cylinder 40 in order to locate the impact driver 75 directly over the vertical post positioned at the location where the post is to be driven into the ground. Also, the three point hitch system illustrated in connection with FIGS. 2 and 3 permit the apparatus 10 to be quickly attached to the arms 102 and 104 projecting rearwardly from a tractor.

As also mentioned above, the connector or link member 77 which directly supports the impact driver 75 in suspended relation, may be interchanged with other link members having different lengths according to the length of the post to be driven. This enables the boom 50 to operate through an optimum angle substantially equally above and below the horizontal reference plane extending through the pivot pin 46 and thereby minimizes horizontal movement of the impact driver 75 while driving a post into the ground. As also disclosed in applicant's above mentioned U.S. Pat. No.

6,796,747, the impact driver 75 may be connected to the universal joint 72 in close relation, and the vertical adjustment of the impact driver 75 may be obtained by telescopically raising and lowering the mast extension 28 on the mast 26, for example, by adjusting the collar 31 vertically on the mast 26.

While the form of post driving apparatus herein described constitutes a preferred embodiment of the invention, it is to be understood that the invention is not limited to this precise form of apparatus, and that changes may be made therein without departing from the scope and spirit of the invention as defined in the appended claims.

What is claimed is:

1. Apparatus adapted to be attached to a motor driven vehicle for driving a post into the ground, said apparatus comprising a frame adapted to be connected to the vehicle, a generally vertical mast supported by said frame for rotation on a generally vertical axis, an elongated boom having a first portion supported by said mast for relative pivotal movement on a generally horizontal axis, a fluid actuated cylinder connecting said mast to said boom for pivoting said boom, a non-extensible connector member having an upper portion connected directly to a second portion of said boom, a fluid actuated impact driver supported directly by said non-extensible connector member in depending relation from said boom and for movement of said impact driver only with movement of said boom, said impact driver having a bottom member for engaging an upper end portion of the post, a second fluid actuated cylinder connecting said mast to said boom, and a fluid valve control system providing for raising said boom and said impact driver upwardly at one rate with limited restriction and lowering said boom and said impact driver downwardly at a controlled slower rate.

2. Apparatus as defined in claim 1 and including a second fluid actuated cylinder connecting said frame to said mast and positioned to rotate said mast on said generally vertical axis in response to a control on the vehicle.

3. Apparatus as defined in claim 1 and including a releasable mounting system secured to said frame for attaching said apparatus to the motor driven vehicle.

4. Apparatus as defined in claim 3 wherein said mounting system comprises an attachment member having a horizontally extending upper flange and a horizontally extending lower flange, and said lower flange having horizontally spaced recesses adapted to receive corresponding retractable latch members on a front end loader vehicle.

5. Apparatus as defined in claim 1 wherein said connector member comprises a rigid link member connected to said boom by a universal coupling and interchangeable with another said link member having a different length to provide for driving posts of different lengths with minimal horizontal movement of said impact hammer.

6. Apparatus as defined in claim 1 wherein said frame includes a support for a supply of posts.

7. Apparatus as defined in claim 1 and including three point hitch members for releasably connecting said apparatus to lift arms and a stabilizing arm of the wheel supported vehicle.

8. Apparatus as defined in claim 1 in combination with a front end loader vehicle having forwardly projecting pivotal arms connected to said apparatus by a quick release attachment.

9. Apparatus as defined in claim 1 and including a U-shaped channel member pivotally supported by said mast and receiving said boom, and said second fluid actuated cylinder connects said channel member to said mast to provide for pivoting said channel member downwardly without pivoting said boom.

10. Apparatus adapted to be attached to a motor driven vehicle for driving a post into the ground, said apparatus comprising a frame adapted to be connected to the vehicle, a generally vertical mast supported by said frame for rotation on a generally vertical axis, an elongated boom having a first portion supported by said mast for relative pivotal movement on a generally horizontal axis, a fluid actuated cylinder connecting said mast to said boom for pivoting said boom, a non-extensible connector member having an upper portion connected directly to a second portion of said boom, a fluid actuated impact driver supported directly by said non-extensible connector member in depending relation from said boom and for movement of said impact driver only with movement of said boom, said impact driver having a bottom member for engaging an upper end portion of the post, a bracket member pivotally supported by said mast and connected to pivot said boom, and said fluid actuated cylinder connects said bracket member to said mast to provide for pivoting said bracket member downwardly without pivoting said boom.

11. Apparatus as defined in claim 10 wherein said bracket member comprises an upwardly facing U-shaped channel member receiving said boom.

* * * * *